US012114700B2

(12) United States Patent
Acconcia et al.

(10) Patent No.: US 12,114,700 B2
(45) Date of Patent: Oct. 15, 2024

(54) SYSTEM COMPRISING AEROSOL-GENERATING DEVICE AND ADAPTER ELEMENT

(71) Applicant: Philip Morris Products S.A., Neuchatel (CH)

(72) Inventors: Federica Acconcia, Salerno (IT); Ivan Prestia, Zola Predosa (IT)

(73) Assignee: Philip Morris Products S.A., Neuchatel (CH)

( * ) Notice: Subject to any disclaimer, the term of this patent is extended or adjusted under 35 U.S.C. 154(b) by 799 days.

(21) Appl. No.: 17/263,753

(22) PCT Filed: Aug. 1, 2019

(86) PCT No.: PCT/EP2019/070762
§ 371 (c)(1),
(2) Date: Jan. 27, 2021

(87) PCT Pub. No.: WO2020/025746
PCT Pub. Date: Feb. 6, 2020

(65) Prior Publication Data

US 2021/0298360 A1 Sep. 30, 2021

(30) Foreign Application Priority Data

Aug. 2, 2018 (EP) ..... 18187101

(51) Int. Cl.
*A24F 40/46* (2020.01)
*A24F 40/20* (2020.01)
(Continued)

(52) U.S. Cl.
CPC ..... *A24F 40/46* (2020.01); *A24F 40/20* (2020.01); *A24F 40/40* (2020.01); *A24F 40/51* (2020.01);
(Continued)

(58) Field of Classification Search
CPC ..... A24F 40/46; A24F 40/20; A24F 40/40; A24F 40/51; A24F 40/53; A24F 40/57;
(Continued)

(56) References Cited

U.S. PATENT DOCUMENTS 4,711,254 A 12/1987 Fleisher et al.
2015/0013696 A1* 1/2015 Plojoux ..... A61M 15/06 131/328
(Continued)

FOREIGN PATENT DOCUMENTS

CA 2 992 941 A1 1/2017
CN 103997922 A 8/2014
(Continued)

OTHER PUBLICATIONS

Japanese Office Action issued Mar. 28, 2022 in Japanese Patent Application No. 2021-505784 (with English translation), 6 pages.
(Continued)

*Primary Examiner* — Justin M Kratt
(74) *Attorney, Agent, or Firm* — Oblon, McClelland, Maier & Neustadt, L.L.P.

(57) ABSTRACT

A system is provided, including an aerosol-generating device including a heating chamber to receive an aerosol-generating article of a first type, the article including an aerosol-forming substrate; and an adapter element to be inserted into the heating chamber and configured to have an outer shape to be at least partly inserted into the chamber, the adapter element having a cavity extending along a longitudinal axis of the adapter element, the cavity being configured so that an aerosol-generating article of a second type having a diameter that is smaller than a diameter of the article of the first type is insertable into the cavity and thereby into the heating chamber, and the adapter element including a detection element configured to enable identification, by the
(Continued)

Figure 1:
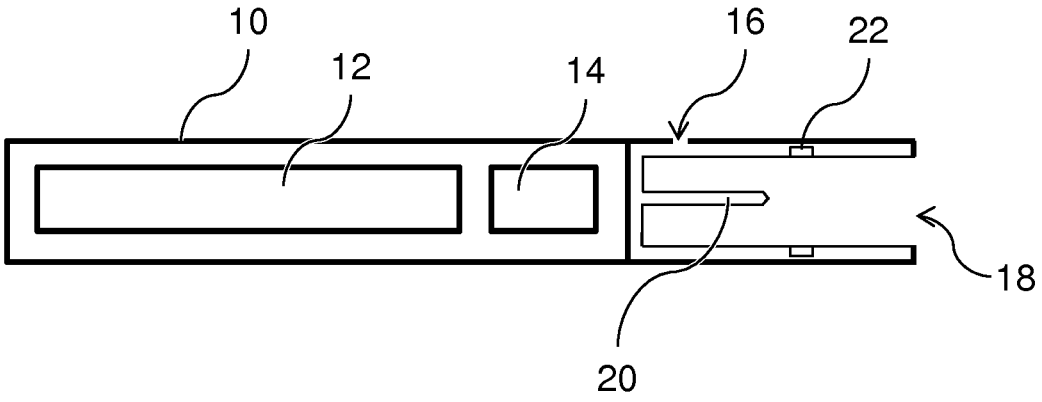

device, of a type of the adapter element inserted into the heating chamber. A set of adapter elements, a kit, and a method are also provided.

15 Claims, 8 Drawing Sheets

(51) Int. Cl.

| | |
|---|---|
| ***A24F 40/40*** | (2020.01) |
| ***A24F 40/51*** | (2020.01) |
| ***A24F 40/53*** | (2020.01) |
| ***A24F 40/57*** | (2020.01) |
| *A24D 1/20* | (2020.01) |
| *A24F 40/42* | (2020.01) |
| *A24F 40/50* | (2020.01) |
| *A24F 40/60* | (2020.01) |
| *A24F 47/00* | (2020.01) |

(52) U.S. Cl.
CPC ..... *A24F 40/53* (2020.01); *A24F 40/57* (2020.01); *A24D 1/20* (2020.01); *A24F 40/42* (2020.01); *A24F 40/50* (2020.01); *A24F 40/60* (2020.01); *A24F 47/00* (2013.01)

(58) Field of Classification Search
CPC ..... A24F 40/42; A24F 40/50; A24F 40/60; A24F 47/00; A24D 1/20
See application file for complete search history.

(56) References Cited

U.S. PATENT DOCUMENTS

| | | | |
|---|---|---|---|
| 2017/0095002 | A1 | 4/2017 | Silvestrini |
| 2018/0214645 | A1* | 8/2018 | Reevell ..... A24F 40/53 |
| 2018/0279681 | A1 | 10/2018 | Rojo-Calderon et al. |

FOREIGN PATENT DOCUMENTS

| | | | |
|---|---|---|---|
| CN | 106793833 | A | 5/2017 |
| CN | 107205484 | A | 9/2017 |
| JP | 2012-513750 | A | 6/2012 |
| JP | 2014-533513 | A | 12/2014 |
| JP | 3201 450 | U | 12/2015 |
| JP | 2017-516256 | A | 6/2017 |
| JP | 2018-504134 | A | 2/2018 |
| JP | 2020-519263 | A | 7/2020 |
| KR | 10-2014-0093694 | A | 7/2014 |
| KR | 10-2016-0145838 | A | 12/2016 |
| KR | 10-2017-0115492 | A | 10/2017 |
| KR | 10-2018-0071323 | A | 6/2018 |
| RU | 2 653 467 | C2 | 5/2018 |
| RU | 2 661 840 | C2 | 7/2018 |
| WO | WO 2013/076098 | A2 | 5/2013 |
| WO | WO 2015/197627 | A1 | 12/2015 |
| WO | WO 2017/068099 | A1 | 4/2017 |
| WO | WO 2018/096000 | A1 | 5/2018 |
| WO | WO 2018/206615 | A2 | 11/2018 |

OTHER PUBLICATIONS

International Search Report and Written Opinion issued Nov. 12, 2019 in PCT/EP2019/070762 filed Aug. 1, 2019.
Korean Notice of Allowance issued Jun. 8, 2023 in Korean Application 10-2021-7000883, (with English translation), 4 pages.
Decision to Grant issued on Jul. 7, 2021 in Russian Patent Application No. 2021102122 (submitting English translation only), 6 pages.
Combined Chinese Office Action and Search Report issued Sep. 20, 2023 in Chinese Patent Application No. 201980045669.3 (with English Translation), 13 pages.

* cited by examiner

SYSTEM COMPRISING AEROSOL-GENERATING DEVICE AND ADAPTER ELEMENT

CROSS-REFERENCE TO RELATED APPLICATIONS

This application is a U.S. national stage application of PCT/EP2019/070762, filed on Aug. 1, 2019, which is based upon and claims the benefit of priority under 35 U.S.C. § 119 from European patent application no. 18187101.3, filed Aug. 2, 2018, the entire contents of each of which are incorporated herein by reference.

TECHNICAL FIELD

The present invention relates to a system comprising an aerosol-generating device and an adapter element for insertion into a heating chamber of the aerosol-generating device.

DESCRIPTION OF THE RELATED ART

Known aerosol-generating devices comprise a housing with a power supply for powering a heating element. The heating element is configured for heating an aerosol-generating article comprising aerosol-forming substrate to generate an aerosol. The heating element is typically arranged in a heating chamber. The aerosol-generating article may have the form of a tobacco rod and can be inserted into the heating chamber.

A multitude of different aerosol-generating articles may potentially be used together with a single aerosol-generating device. However, the different aerosol-generating articles may have different shapes and particularly different diameters, so that different aerosol-generating articles may not fit properly into the heating chamber of a given aerosol-generating device or more than one aerosol-generating device has to be provided for using different types of aerosol-generating articles.

Consequently, there is a need for an aerosol-generating device with a higher variability for using different aerosol-generating articles.

SUMMARY

For solving this and other problems, the present invention proposes to provide a system comprising an aerosol-generating device. The aerosol-generating device comprises a heating chamber. The heating chamber is configured to receive an aerosol-generating article of a first type. The aerosol-generating article comprises aerosol-forming substrate. The system further comprises an adapter element for insertion into the heating chamber of the aerosol-generating device. The adapter element is configured having an outer shape to be at least partly inserted into the heating chamber of the aerosol-generating device. The adapter element has a cavity extending along the longitudinal axis of the adapter element. The cavity is configured so that an aerosol-generating article of a second type having a diameter which is smaller than the diameter of the aerosol-generating article of the first type can be inserted into the cavity and thereby into the heating chamber.

The system enables easy adaption of an aerosol-generating device so that different aerosol-generating articles can be used with a single aerosol-generating device. In this regard, a heating chamber of the aerosol-generating device may have a shape which is optimized for inserting a specific type of aerosol-generating articles. These aerosol-generating articles may be of the first type and have a given diameter so that the heating chamber is optimized for insertion of these aerosol-generating articles. However, different aerosol-generating articles may exist with a smaller diameter, wherein a user may also wish to insert and use these aerosol-generating articles in the same aerosol-generating device. Aerosol-generating articles which are not of the first type may be denoted as aerosol-generating articles of the second type. These aerosol-generating articles have a smaller diameter in comparison to aerosol-generating articles of the first type and are denoted as aerosol-generating articles of the second type.

The system according to the present invention enables the usage of different aerosol-generating articles, particularly aerosol-generating articles with different diameters of the second type, within a single aerosol-generating device. To this end, the user may insert the adapter element into the heating chamber of the aerosol-generating device so that the diameter of the opening of the heating chamber is reduced in comparison with the initial opening of the heating chamber. In this way, aerosol-generating articles of the second type with reduced diameter may optimally fit into the heating chamber modified by the adapter element.

The heating chamber of the aerosol-generating device may have a diameter corresponding to the diameter of the aerosol-generating article of the first type so that the article of the first type is securely held in the heating chamber. Correspondingly, the cavity of the adapter element may have a diameter corresponding to the diameter of aerosol-generating article of the second type so that the article is securely held in the adapter element. Preferably, the heating chamber may be configured so that an article of the first type may be received in the heating chamber in a relatively snug fit, for example so that an external surface of an article of the first type at least partially contacts a surface of the heating chamber. Preferably more than 50% of the external surface of an article of the first type contacts the internal surface of the heating chamber when the article of the first type is inserted into the heating chamber. Preferably, an article of the first type and the heating chamber are dimensioned so that an article of the first type is retained in the heating chamber by the snug fit. The fit may also be described as an interference fit or a friction fit.

Similarly, the cavity of the adapter element may be configured for receiving an aerosol-generating article of the second type in a relatively snug fit, exemplarily so that an external surface of an article of the second type at least partially contacts a surface of the adapter element. Preferably more than 50% of the external surface of an article of the second type contacts the internal surface of the adapter element if inserted into the adapter element.

Articles of the first type may have a circularly-cylindrical cross-section that is substantially similar to the cross-section of the heating chamber. Articles of the second type may have a circularly-cylindrical cross-section that is substantially similar to the cross-section of the cavity of the adapter element. The diameter of articles of the first type may be slightly larger than the diameter of the heating chamber. As such, articles of the first type may be received in the heating chamber with a snug fit, an interference fit or a friction fit. The fit ensures contact between the articles and the heating chamber/adapter element, when a corresponding article is received in the heating chamber/adapter element. The fit provides some resistance against movement of the corresponding article along the longitudinal axis of the aerosol-generating device. As such, the fit helps to retain the corresponding article within the heating chamber/adapter element. The diameter of articles of the second type may be slightly larger than the diameter of the cavity of the adapter element. As such, articles of the second type may be received in the cavity of the adapter element with a snug fit, an interference fit or a friction fit. The fit ensures contact between the articles and the heating chamber/adapter element, when a corresponding article is received in the heating chamber/adapter element. The fit provides some resistance against movement of the corresponding article along the longitudinal axis of the aerosol-generating device. As such, the fit helps to retain the corresponding article within the heating chamber/adapter element.

If a diameter of an article of the first type is too small, or if a diameter of the heating chamber is too large, or if both a diameter of the first article is to small and a diameter of the heating chamber is too large, then an air gap is present between an article of the first type and the heating chamber when the article of the first type is received in the heating chamber. An air gap may cause thermal losses, reducing efficiency of heating of an article. Generated aerosol may be lost via an air gap. An air gap may adversely affect resistance to draw of the system. Similar disadvantages may be present if a diameter of an article of the second type is too small, or if a diameter of the cavity of the adapter element is too large, or if both a diameter of an article of the second type is too small and a diameter of the adapter element is too large.

Advantageously, proximity or contact between an article of the first type and the heating chamber or between an article of the second type and the cavity of the adapter element reduces or eliminates an air gap, increasing thermal contact, which reduces both thermal losses. Reduced chances of losing aerosol through the air gap and RTD maintained within a desirable range. By providing the heating chamber with a diameter suitable for aerosol-generating articles of the first type and by providing the adapter element with a diameter suitable for aerosol-generating articles of the second type, these disadvantages may be prevented or reduced while at the same time facilitating secure holding of the corresponding articles within the heating chamber or adapter element, respectively.

The adapter element preferably has a shape so that the heating element which is typically arranged in the heating chamber of the aerosol-generating device is not negatively impaired when the adapter element is inserted into the heating chamber. The walls of the adapter element may have a thickness so that the adapter element can be inserted between the inner wall of the heating chamber and the heating element which is typically arranged centrally aligned within the heating chamber. The adapter element may thus have a shape to be arranged directly adjacent to the inner wall of the heating chamber and distanced from the heating element.

The adapter element preferably has a hollow tubular shape. The adapter element may also be denoted as a bushing, a fitting, a sleeve, or a tube. The adapter element may be configured such that the cavity may have a shape so that an aerosol-generating article of the second type fits into the cavity of the adapter element. The cavity may have a diameter such that an aerosol-generating article of the first type may not fit into the cavity. The outer shape of the adapter element may also be referred as the outer dimension of the adapter element.

That the adapter element is configured having an outer shape to be at least partly inserted into the heating chamber means that the adapter element fits into the heating chamber. In other words, the adapter element can extend into the heating chamber.

The adapter element may have a cylindrical outer shape. The adapter element may have a circular cross section. The cylindrical outer shape of the adapter element may be in alignment with a cylindrical shape of the heating chamber. If the heating chamber of the aerosol-generating device does not have a cylindrical shape, the adapter element may have a corresponding shape so that the adapter element fits into the heating chamber of the aerosol-generating device. For example, the heating chamber may have an oval cross section or may not have the same cross section along the full longitudinal length of the heating chamber. The adapter element may thus have a corresponding shape, such as an oval shape or the cross section of the adapter element may vary along the longitudinal axis of the adapter element.

The outer wall of the adapter element may be a continuous wall. In an alternative embodiment, the outer wall of the adapter element may comprise at least one aperture. The aperture may be configured to enable ambient air to flow into the heating chamber. The adapter element may have the shape of two rings, wherein one ring is arranged adjacent to the opening of the adapter element for insertion of an aerosol-generating article and the other ring may be arranged adjacent distanced from the first ring in the direction of the base of the heating chamber. An aerosol-generating article inserted into the adapter element may be surrounded by the two rings and held thereby. Multiple rings may be provided in the adapter element to hold an aerosol-generating article.

The adapter element may have a cylindrical cavity. Preferably, the adapter element has a cylindrical cavity, since aerosol-generating articles typically have a circular cross section. When the cavity of the adapter element has a cylindrical shape, such typical aerosol-generating articles can be inserted into the adapter element. The inner dimension of the cavity may be configured for insertion of an aerosol-generating article of the second type. The cavity may be configured to retain an inserted aerosol-generating article by a friction fit. The inner diameter of the cavity may correspond to the outer diameter of an aerosol-generating article to be inserted. However, other shapes of the cavity of the adapter element are possible. Particularly, shapes of the cavity are possible which correspond to different shapes of aerosol-generating articles. Similar to the shape of the heating chamber, the cavity of the adapter element may have an oval cross section or a cross section which is different along the longitudinal length of the adapter element. The cavity may be provided as a through-hole. The cavity may have a base with an opening for insertion of a heating element such that the heating element is slided through the opening during insertion of the adapter element into the heating chamber. The opening may be provided to scrap off unwanted residues from the heating element during insertion of the adapter element into the heating chamber.

A heating chamber of an aerosol-generating device may have specific elements such as longitudinal protrusions, for example for air inlets. Similar elements may be arranged along the longitudinal length of aerosol-generating articles. The adapter element may in these cases have a corresponding shape. That means that the outer shape of the adapter elements may mirror the shape of the inner wall of a heating chamber of an aerosol-generating device. The adapter element may consequently have longitudinal protrusions or grooves along the longitudinal length of the outer surface of the adapter element. The cavity of the adapter element may comprise longitudinal grooves or protrusions.

The adapter element may be configured to reduce an opening diameter of the heating chamber for inserting an aerosol-generating article to the inner diameter of the cavity for inserting the aerosol-generating article.

The adapter element may thus particularly be suited for using aerosol-generating articles of the second type with a smaller diameter together with an aerosol-generating device which is typically designed for using aerosol-generating articles of the first type with a larger diameter.

The adapter element may comprise a stopper configured to limit the adapter element from being fully inserted into the heating chamber.

In this regard, the adapter element may not have a shape to fully reach towards the base of the heating chamber of the aerosol-generating device, but only be inserted into the first part, seen from the opening of the heating chamber, of the heating chamber so that the opening of the heating chamber is adapted to the diameter of aerosol-generating articles of the second type which are to be used with the aerosol-generating device. To facilitate this insertion of the adapter element into the heating chamber of the aerosol-generating device, the stopper may be configured so that the adapter element can only be inserted into the heating chamber of the aerosol-generating device until the stopper retains the adapter element from being further inserted into the heating chamber.

The stopper may be configured for removing the adapter element from the heating chamber.

The removability of the stopper may aid in using different stoppers together with a single aerosol-generating device. In this regard, the possibility of removing the adapter elements may be utilized in that different adapter elements can be used. These different adapter elements may have, for example, different sized cavities so that different aerosol-generating articles can be used in connection with the different adapter elements.

The stopper may be configured as one or more of a protruding rim, a grove, an extending element, a ridge or a handhold.

Any type of protruding elements such as a protruding rim or an extending element may use the shape of the heating chamber and use the opening portion of the heating chamber as a stop element for stopping the adapter element from being inserted further into the heating chamber than desired. The stopper may be configured as a shoulder, flange or rib. Separately or in addition to such an element, the stopper may comprise a handhold so that a user can easily grip the adapter element and remove the adapter element from the heating chamber. The handhold may be a portion of a protruding element of the adapter element. The handhold may comprise a handle to be gripped by a user. The handhold may comprise gripping regions on opposite sides of the adapter element so that a user may hold the adapter element between two fingers. A tool may be provided to engage with the stopper to enable gripping and handling of the stopper.

The adapter element may comprise a retaining element, which may be configured to attach the adapter element to the heating chamber after insertion of the adapter element into the heating chamber.

Instead of using different adapter elements together with different aerosol-generating articles, it may also be conceived to amend the shape of the heating chamber of the aerosol-generating device by inserting an adapter element into the heating chamber. The retaining element may be configured to permanently attach the adapter element to the heating chamber. Preferably, the retaining element enables to releaseably attach the adapter element to the heating chamber. The retaining element may be configured as a resilient protrusion on an outer surface of the adapter element to engage with a detent on an inner wall of the heating chamber. During use of the aerosol-generating device, the retaining element may be configured to securely hold the adapter element within the heating chamber. The retaining element of the adapter element may be utilized for safely securing the adapter element within the heating chamber of the aerosol-generating device. The retaining element may have any suitable shape such as a snap fit connection. The retaining element preferably is arranged on the outer surface of the adapter element. Preferably, the inner wall of the heating chamber comprises a corresponding retaining element so that the retaining element of the adapter element can engage with the corresponding retaining element arranged in the heating chamber.

The invention further relates to a set of adapter elements, wherein each adapter element is configured having an outer shape to be at least partly inserted into a heating chamber of an aerosol-generating device. Each adapter element may have a cavity extending along the longitudinal axis of the adapter element. The cavity may be configured so that an aerosol-generating article comprising aerosol-forming substrate can be inserted into the cavity. The adapter elements may differ in one or more of the diameter of the cavity, color, surface structure or shape for enabling different aerosol-generating articles to be used in the aerosol-generating device.

The diameter of the cavity of different adapter elements may be varied to enable the usage of aerosol-generating articles of different diameters is to be used in conjunction with a single aerosol-generating device. If the adapter elements have different colors or surface structures, a user may easily identify which adapter element to be used in conjunction with a certain aerosol-generating article. Preferably, the aerosol-generating articles are color-coded in the same way as the adapter elements are color-coded so that the user may easily identify the adapter element to be used in conjunction with a certain aerosol-generating article. Also, the shape of the adapter elements may be modified to enable a simplified identification of the type of adapter element. The surface structure of a specific identification area of the adapter elements may be configured to enable identification of the adapter element by touching the respective area.

The adapter element may comprise a detection element configured to enable identification, by the aerosol-generating device, of the type of adapter element inserted into the heating chamber.

The detection element may enable an identification of the adapter element which is inserted to the heating chamber of an aerosol-generating device. In this regard, the aerosol-generating device may comprise a corresponding detection element so that, upon insertion of the adapter element into the heating chamber of the aerosol-generating device, the aerosol-generating device may identify the specific adapter element which has been inserted into the heating chamber of the aerosol-generating device.

The detection element may be one or more of a sensor, a poka yoke, encoding, a magnet, a color element, and an electrically conductive element.

The different configurations of the detection element enable a reliable identification of the specific adapter element which has been inserted into the heating chamber of the aerosol-generating device. In case a poka yoke is utilized for the detection element, it may also be guaranteed that no adapter element is inserted into the heating chamber of the aerosol-generating device which is not compatible with the aerosol-generating device.

The adapter element may comprise and preferably consist of susceptor material. This enables usage of the adapter element as a heating element. An induction coil may be wound around the heating chamber. After insertion of the adapter element into the heating chamber, electrical current may be supplied to the coil which induces a magnetic field. The magnetic field may induce eddy currents in the susceptor material of the adapter element which may result in the susceptor material being heated. The susceptor material may be provided in the part of the adapter element which is fully inserted into the heating chamber. The part of the adapter element which is not fully inserted into the heating chamber such as a rim of the adapter element may be made from electrically insulating material to prevent heating of this part of the adapter material. Susceptor material in the adapter element may be provided in addition to further susceptor material arranged as a heating blade or pin within the heating chamber. In this way, uniform heating of an inserted aerosol-generating article may be achieved.

The system may further comprise an extractor element. The extractor element may be configured having an outer shape to be at least partly inserted into the heating chamber between the adapter element and the inner wall of the heating chamber. The extractor element may be configured movable between an operation position and an extraction position. The extractor element may be configured for at least partly separating an aerosol-forming article from a heating element of the aerosol-generating device in the extraction position.

The operating position may be a position in which the extractor element is inserted into the heating chamber so that an aerosol-generating article inserted into the extractor element is contacted by a heating element of the aerosol-generating device.

The extractor element may be configured to essentially not change the diameter of the heating chamber so that aerosol-generating articles of the first type can be inserted into the heating chamber, when the extractor element is inserted into the heating chamber. The extractor element is configured to facilitate ease of removal of a depleted aerosol-generating article. Similar to the adapter element, the extractor element may comprise elements for securely holding the extractor element within the heating chamber, elements for enabling removal of the extractor element from the heating chamber and elements for preventing over insertion of the extractor element and for gripping of the extractor element. These elements may be configured as one of more of a stopper, a protruding rim, a groove, an extending element, a ridge, a handhold and a retaining element. Also similar to the adapter element, the shape of the extractor element may be adapted to the heating chamber and to different aerosol-generating articles. The extractor element may have a cavity for enabling insertion of an aerosol-generating article of the first type or alternatively of the adapter element. The extractor element may have a cylindrical outer shape. The cavity of the extractor element may have a circular cross section, an oval cross section or may not have the same cross section along the full longitudinal length of the extractor element.

The extractor element differs from the adapter element at least in the thickness of the wall being arranged adjacent to the inner wall of the heating chamber after insertion of the extractor element. This wall of the extractor element is a relatively thin wall such that the diameter of the heating chamber is essentially the same when the extractor element is inserted into the heating chamber. The functionality of the extractor element is to enable simplification of removal of a depleted aerosol-generating article. Consequently, an aerosol-generating article of the first type or the adapter element can still be inserted into the heating chamber after the extractor element has been inserted into the heating chamber. In this case, the extractor element is disposed between the aerosol-generating article or the adapter element and the inner wall of the heating chamber. The corresponding wall of the adapter element has a thickness such that the diameter of the heating chamber is reduced after insertion of the adapter element into the heating chamber. In other words, the extractor element is configured to facilitate removal of aerosol-generating articles from the heating chamber, while the adapter element is configured to enable usage of aerosol-generating articles of the second type with reduced diameter. When the extractor element is used without the adapter element, removal of aerosol-generating articles of the first type is simplified by the extractor element. When the extractor element is used together with the adapter element, removal of aerosol-generating articles of the second type is simplified by the extractor element.

The heating chamber of the aerosol-generating device according to the invention is specifically configured so that an adapter element can be inserted into the heating chamber. In this regard, the heating chamber may be configured so that different aerosol-generating articles of the second type can be used in the aerosol-generating device upon insertion of the corresponding adapter element. Without the adapter element being inserted into the heating chamber, aerosol-generating articles of the first type may be inserted into the heating chamber. The aerosol-generating device may be operated without usage of the adapter element and with aerosol-generating articles of the first type being inserted into the heating chamber. In other words, the heating chamber may be configured to allow insertion of aerosol-generating articles of the first type and subsequent operation of the aerosol-generating device to generate an inhalable vapor. There is no need for modification of the heating chamber for insertion of aerosol-generating articles of the first type and for operation of the device. The adapter element thus enables the usage of aerosol-generating articles of the second type after being inserted into the heating chamber in addition to the potential usage of aerosol-generating articles of the first type in the heating chamber without inserted adapter element.

The heating chamber may comprise a detection element configured to detect the type of adapter element inserted into the heating chamber, and preferably configured to interact with a corresponding detection element of the adapter element for the detection of the type of adapter element.

The detection element arranged in the heating chamber enables a detection of the type of adapter element which has been inserted into the heating chamber of the aerosol-generating device. As a consequence of the identification of a specific adapter element, the operation mode of the aerosol-generating device may be adapted. Particularly, a specific adapter element may only be used in conjunction with specific aerosol-generating articles of the second type. For example, aerosol-generating articles of the second type with reduced diameter may be used in conjunction with a specific adapter element compared to standard aerosol-generating articles of the first type which are used in the aerosol-generating device when no adapter element is inserted to the heating chamber. Alternatively or additionally, different operational modes of the aerosol-generating device may be controlled by insertion of different adapter elements. For example, the heating temperature may vary in accordance with the insertion of different adapter elements.

When aerosol-generating articles of the second type of a smaller diameter are used in conjunction with a specific adapter element, the operation mode of the aerosol-generating device may vary. Particularly, the aerosol-generating device may be configured to use a specific heating regime as a consequence of the detected adapter element. The temperature of the heating element may be lowered. Also, the temperature rise during initialization of the heating element may be controlled to be slower. It is also conceivable that the aerosol-generating articles of the second type differ with respect to the used aerosol-forming substrate such as tobacco. Hence, also these differences may be detected by inserting a specific adapter element. In this regard, the adapter elements may be arranged for using different sources of aerosol-generating articles differing from each other in parameters such as the used smoke-generating substance, flavourants, filters, or other parameters which influence the smoking experience while having a reduced diameter. Respective adapter elements may be identified by the aerosol-generating device.

The aerosol-generating device may comprise a controller for controlling the operation mode of the aerosol-generating device. The controller may be configured for controlling the operation of a heater of the device configured for heating the aerosol-forming substrate of the aerosol-generating article. Preferably, the controller controls operation of the heater specifically in reaction to the detected inserted adapter element. The controller may be arranged to receive a signal indicative of the detection element, determine the type of adapter and optionally output a signal to control the heating regime.

The detection element may be one or more of a sensor, a poka yoke, encoding, a magnet, a color element, and an electrically conductive element. A corresponding detection element may be provided on the inner wall of the heating chamber of the aerosol-generating device. This detection element may be connected with a controller of the aerosol-generating device for controlling the device on basis of the detected adapter element.

The invention also relates to a system comprising the aerosol-generating device, the adapter element and an aerosol-generating article of the first type as described above. The invention also relates to a system comprising the aerosol-generating device, the adapter element and an aerosol-generating article of the second type as described above. The invention also relates to a system comprising the aerosol-generating device, the adapter element, an aerosol-generating article of the first type and an aerosol-generating article of the second type as described above. The invention also relates to a kit. The kit may comprise a system and a set of adapter elements as described above.

The invention also relates to a method comprising:

i) providing a system as described above, ii) at least partly inserting the adapter element into the heating chamber, iii) inserting an aerosol-generating article of the second type into the cavity of the adapter element, and iv) heating the aerosol-forming substrate of the aerosol-generating article of the second type by means of a heating element of the aerosol-generating device to generate an inhalable aerosol.

The method enables usage of aerosol-generating articles of the second type with a reduced diameter in an aerosol-generating system with a heating chamber which has a diameter larger than the diameter of the aerosol-generating articles of the second type. By inserting the adapter element, the aerosol-generating articles of the second type may be inserted by the user and used, while aerosol-generating articles of the first type may be used by the user before insertion of the adapter element. The user may also insert an aerosol-generating article of the second type into the adapter element before insertion of the adapter element into the heating chamber.

The system may further comprise a detection element provided in at least one of the adapter element and the heating chamber and configured to enable identification, by the aerosol-generating device, of the type of adapter element inserted into the heating chamber. The method may further comprise during ii) and before iv):

detecting, by means of the detection element, of the type of adapter element inserted into the heating chamber. The method may further comprise, after said detecting during iv):

controlling a heating regime of the heating element on basis of the detected adapter element in dependence on said detecting.

The detection element enables identification of the type of adapter element inserted into the heating chamber. The identification of the type of adapter element may be utilized for controlling the heating, such as a heating regime, of an inserted article. The term 'heating regime' denotes a parameter of the heating element of the aerosol-generating device such as maximum temperature, temperature progression during operation and length of heating. Said controlling a heating regime, may comprise inhibiting initiation of a heating regime. This may prevent the device from being operated with adapter elements of another type, such as adapter elements which are not compatible with the provided device, or are intended for another type of device.

The heating element of the aerosol-generating device may be any suitable heating element capable of being inserted into the aerosol-forming substrate of the aerosol-generating article. For example, the heating element may be in the form of a pin or blade.

The method may further comprise, before i):

inserting an aerosol-generating article of the first type into the heating chamber, and heating the aerosol-forming substrate of the aerosol-generating article of the first type by means of the heating element of the aerosol-generating device to generate an inhalable aerosol.

Hence, a user may use aerosol-generating articles of the first type with a diameter which correspond to the diameter of the heating chamber. In addition, the user may wish to use aerosol-generating articles of the second type with a reduced diameter. In this case, the user inserts the adapter element into the heating chamber to enable insertion of the aerosol-generating articles of the second type into the heating chamber. Before insertion of the adapter element, the user may remove the article of the first type prior to insertion of the adapter element. The adapter element facilitates secure holding of the aerosol-generating articles of the second type in the heating chamber.

The method may further comprise, after iv):

removing the adapter element from the heating chamber, inserting an aerosol-generating article of the first type into the heating chamber, and heating the aerosol-forming substrate of the aerosol-generating article of the first type by means of the heating element of the aerosol-generating device to generate an inhalable aerosol.

The method facilitates usage of aerosol-generating articles of the first type after usage of aerosol-generating articles of the second type. If desired, a user may switch from usage of aerosol-generating articles of the first type to usage of aerosol-generating articles of the second type by removing the adapter element from the heating chamber. Then, aerosol-generating articles of the first type may readily be used without modification of the heating chamber by insertion of aerosol-generating articles of the first type into the heating chamber and operation of the aerosol-generating device. The adapter element may therefore be repeatedly be inserted in or removed from the chamber as desired by a user in dependence on whether they wish to generate an inhalable aerosol using the aerosol-generating articles of the first type or the aerosol-generating articles of the second type.

FIG. 1 shows an aerosol-generating device according to the system of the present invention. The device comprises a main body 10 with a power supply 12 and a controller 14. At the downstream end of the device, the device comprises an air inlet 16, a heating chamber 18 and a heating element 20. The heating element 20 is arranged within the heating chamber 18. At the inner wall of the heating chamber 18, at least one detection element 22 is provided.

The heating chamber 18 of the aerosol-generating device is adapted so that an adapter element as described in more detail below can be inserted into the heating chamber. The detection element 22 is provided for detecting a specific type of adapter element which is inserted to the heating chamber 18. Depending upon the detected adapter element, the controller 14 can control the power supply from the power source 12 towards the heating element 20. In this regard, the heating element 20 is preferably an electric heating element such as a heating blade and the heating regime of the heating element 20 can be controlled by the controller 14 depending upon the detected adapter element.

Figure 2:
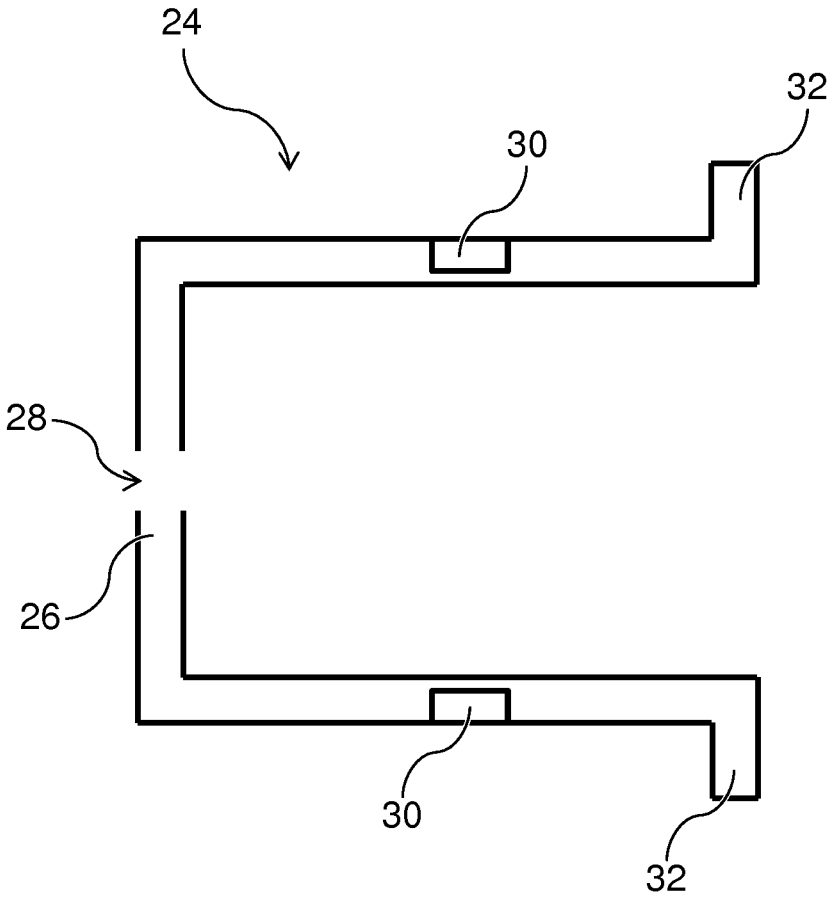
Figure 3:
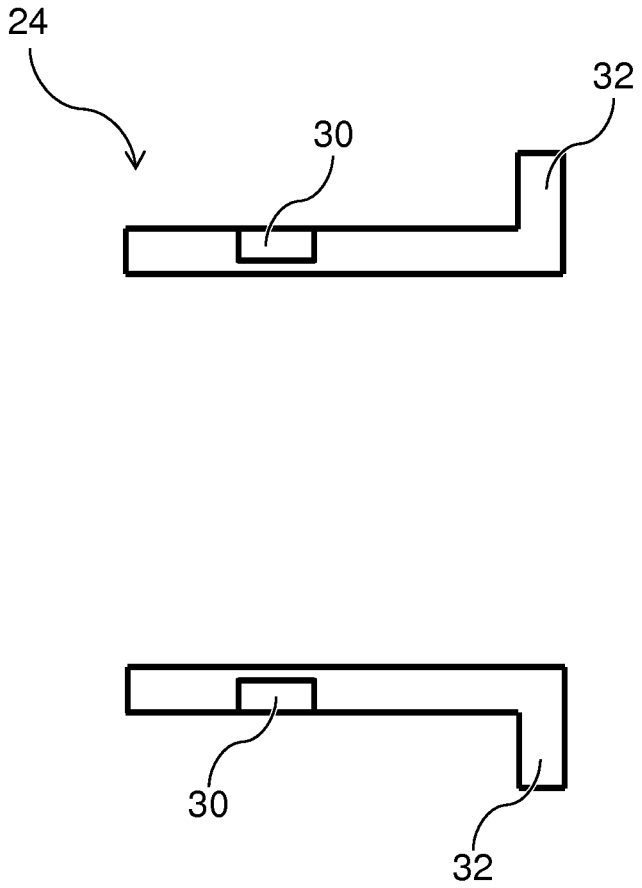

Referring to FIG. 2, this Figure shows an adapter element 24 according to a first embodiment of the present invention. The adapter element 24 has a shape so that the adapter element 24 can be inserted into the heating chamber 18 of an aerosol-generating device such as depicted in FIG. 1. The base 26 of the adapter element 24 may comprise an opening or hole 28 so that the heating element 20 arranged in the heating chamber 18 can penetrate through the hole 28 during insertion of the adapter element 24 into the heating chamber 18 of the aerosol-generating device. Alternatively, as depicted in the second embodiment shown in FIG. 3, the adapter element 24 may have a tubular shape. The different adapter elements as shown in FIGS. 2 and 3 both comprise at least one detection element 30. The detection element 30 is preferably configured as a poka yoke. The detection element 30 is utilized for detecting the specific type of adapter element 24, which is inserted into the heating chamber 18 of the aerosol-generating device.

As can also be seen in FIGS. 2 and 3, the adapter elements comprise a stopper 32 for retaining the adapter element 24 during insertion of the adapter element 24 into the heating chamber 18 of the aerosol-generating device. The stopper 32 has a shape so that the adapter element 24 can only be inserted to a predetermined degree into the heating chamber 18 of the aerosol-generating device. The stopper 32 is preferably configured as a protruding shoulder.

Figure 4:
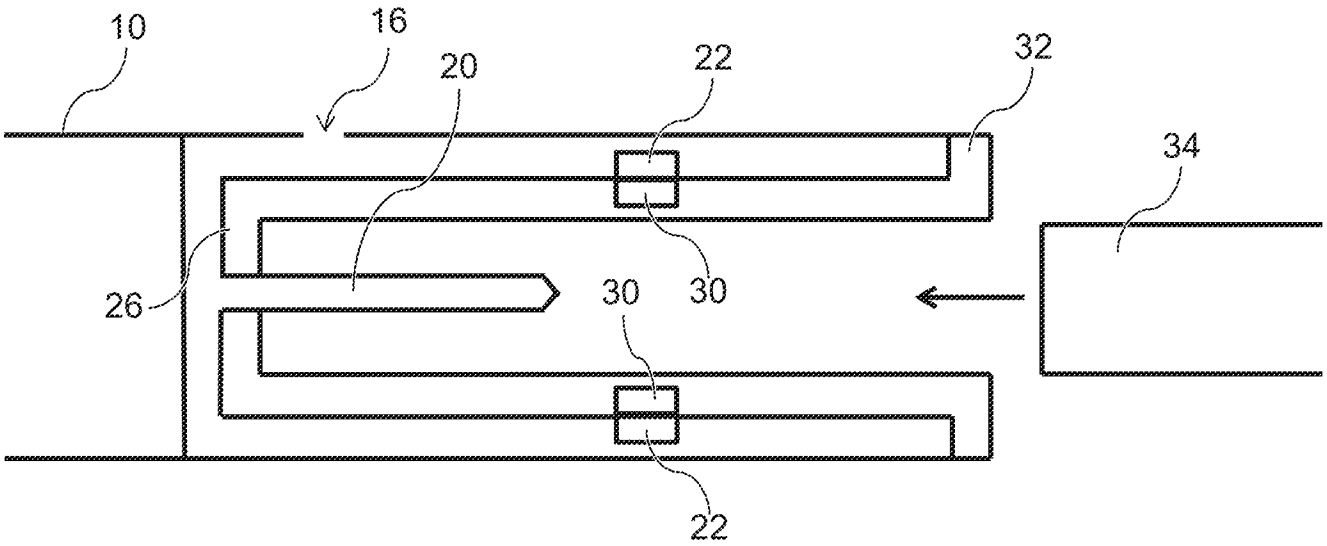

FIG. 4 shows the insertion of the adapter element 24 as depicted in FIG. 2 into the aerosol-generating device as depicted in FIG. 1. Also, an aerosol-generating article 34 is depicted in FIG. 4, which can be inserted along the direction of the arrow into the heating chamber 18 of the aerosol-generating device. By means of the adapter element 24, an aerosol-generating article 34 of smaller diameter can be inserted into the heating chamber 18 and held securely therein by the adapter element 24.

In FIG. 4, it can also be seen that the detection element 22 arranged at the inner wall of the heating chamber 18 of the aerosol-generating device is arranged adjacent to the detection element 30 arranged on the outer surface of the adapter element 24, when the adapter element 24 has been inserted into the heating chamber 18 of the aerosol-generating device. When the two detection elements 22 and 30 are arranged directly next to each other, the controller 14 may determine the type of adapter element 24, which has been inserted into the heating chamber 18 of the aerosol-generating device. For facilitating that the two detection elements 22 and 30 are arranged next to each other after insertion of the adapter element 24 into the heating chamber 18, a guiding element may be arranged on the outer surface of the adapter element 24. The inner walls of the heating chamber 18 may be provided with a corresponding guiding element.

In FIG. 4, it can also be seen that the heating element 20 has been guided through the hole 28 provided in the adapter element 24.

Figure 5:
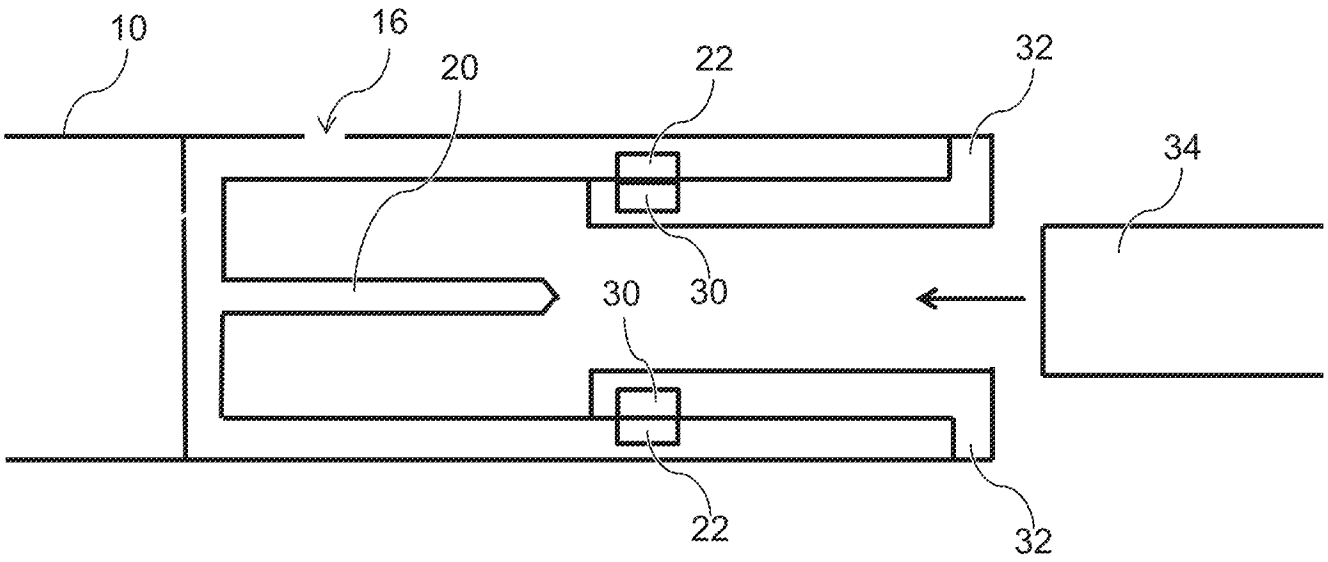

In comparison to FIG. 4, FIG. 5 shows the adapter element 24 as depicted in FIG. 3 inserted into the heating chamber 18 of the aerosol-generating device. In this regard, the length of the adapter element 24 shown in FIG. 3 and inserted into the heating chamber 18 as depicted in FIG. 5 is shorter than the length of the adapter element 24 shown in FIG. 2. This may aid in reducing friction, when an aerosol-generating article is removed from the heating chamber 18. In this regard, the friction between the aerosol-generating article 34 and the heating element 20 is increased in the embodiment shown in FIG. 4 due to the reduced space between the heating element 20 and the adapter element 24 in comparison to not using an adapter element 24. This may also be desired. In the embodiment shown in FIG. 5, the space next to the heating element 20 is similar to the case when no adapter element 24 is used, since the adapter element 24 does not extend all the way from the opening to the base 26 of the heating chamber 18. The adapter element 24 may extend 80%, preferably 50%, and more preferably 20 to 40% along the length of the heating chamber 18 of the aerosol-generating device seen from the opening of the heating chamber 18. The inner diameter of the adapter element 24 may be between 4 mm to 8 mm, preferably 5 mm to 7 mm, preferably 5 mm to 6.5 mm, and more preferably around 5.7 mm. This is also denoted as the inner diameter of the cavity of the adapter element 24. The tubular shaped outer surface of the adapter element may have a diameter of between 7 mm to 9 mm, preferably 7.5 mm to 8.5 mm, and more preferably around 7.8 or 7.9 mm. The stopper 32 of the adapter element 24 may have an outer diameter of between 1 mm to 5 mm, preferably around 3 mm in addition to the outer diameter of the tubular part of the adapter element 24 so that a protruding rim is formed for limiting the amount the adapter element 24 can be inserted into the heating chamber 18 of the aerosol-generating device.

Figure 6:
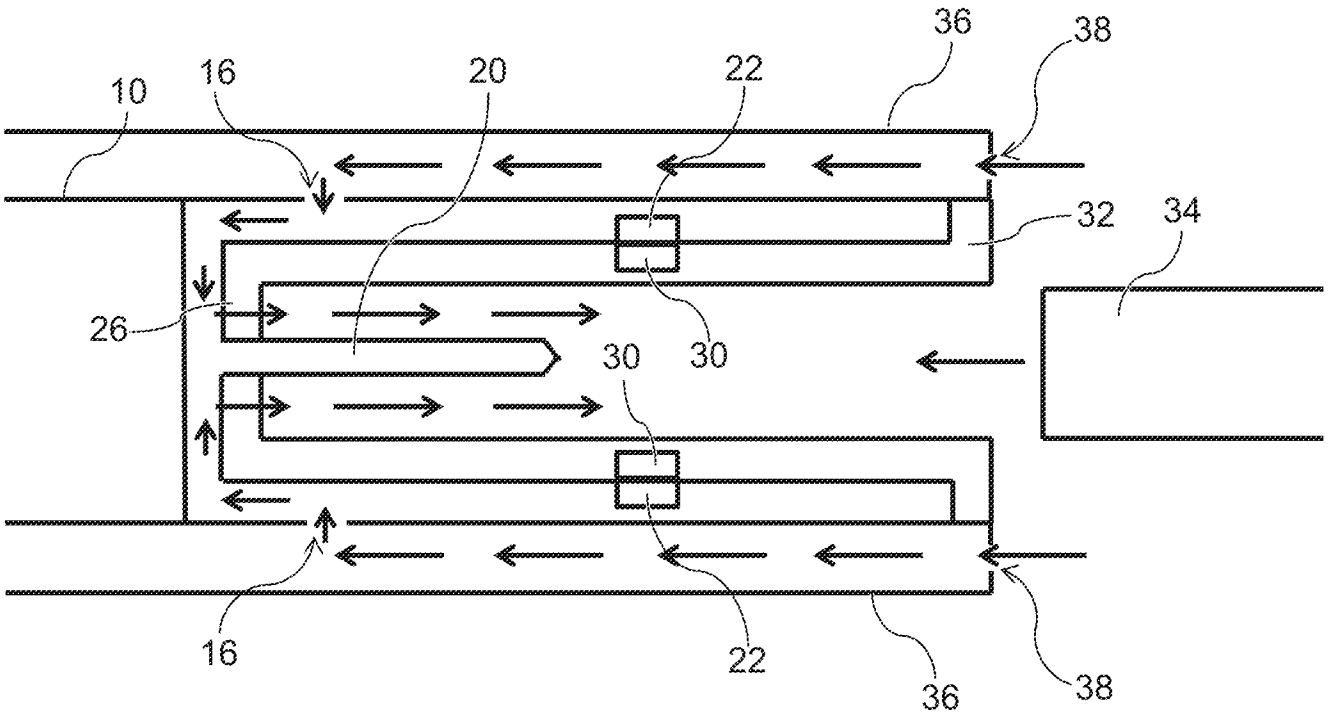

FIG. 6 shows the airflow from ambient air towards and through the heating chamber 18. The airflow is indicated by arrows except for the arrow indicating the insertion of the aerosol-generating article 34. The housing 36 of the aerosol-generating device is depicted in FIG. 6. The housing 36 comprises air inlets 16, 38. Air is drawn through the air inlets 16, 38 towards the base of the heating chamber 18. The base of the heating chamber 18 is configured for enabling airflow towards the inner of the heating chamber 18. The base 26 of the adapter element 24 comprises one or more openings for enabling airflow through the base 26. Air may thus be drawn from outside of the aerosol-generating device into the device and to the base of the heating chamber 18, form where the air may be further be drawn through an inserted aerosol-generating article 34 and towards the mouth of a user.

Figure 7A:
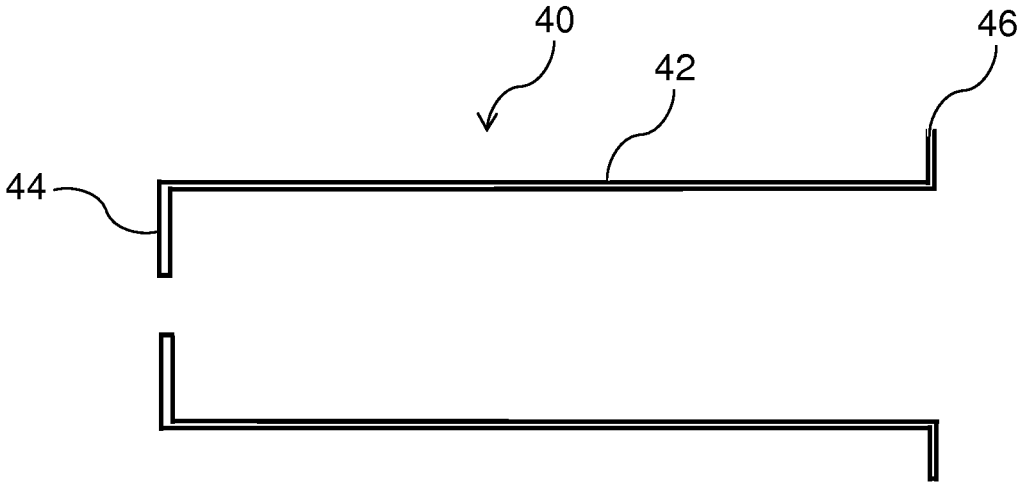

FIG. 7 shows an extractor element 40, which may be used together with any one of the adapter elements 24 as described above. Particularly, the extractor element 40 may be used together with the adapter elements 24 shown in FIGS. 2 and 3, preferably with the adapter element 24 shown in FIG. 3. The extractor element 40 is configured for insertion into the heating chamber 18. The extractor element 40 has an inner wall 42 which is arranged adjacent to the inner wall of the heating chamber 18 after insertion of the extractor element 40 into the heating chamber 18. The inner wall 42 of the extractor element 40 is thin compared to the wall of the adapter element 24 so that the diameter of the heating chamber 18 remains essentially unchanged after insertion of the extractor element 40 into the heating chamber 18. Thus, aerosol-generating articles 34 of the first type may be used when the extractor element 40 is inserted into the heating chamber 18, while no adapter element 24 is used. The extractor element 40 further comprises a base 44 for facilitating removal of depleted aerosol-generating articles 34. The extractor element 40 may further comprise a protruding rim 46 for ease of removal of the extractor element 40 from the heating chamber 18. The extractor element 40 may further comprise additional elements for holding the extractor element 40 within the heating chamber 18.

Figure 7B:
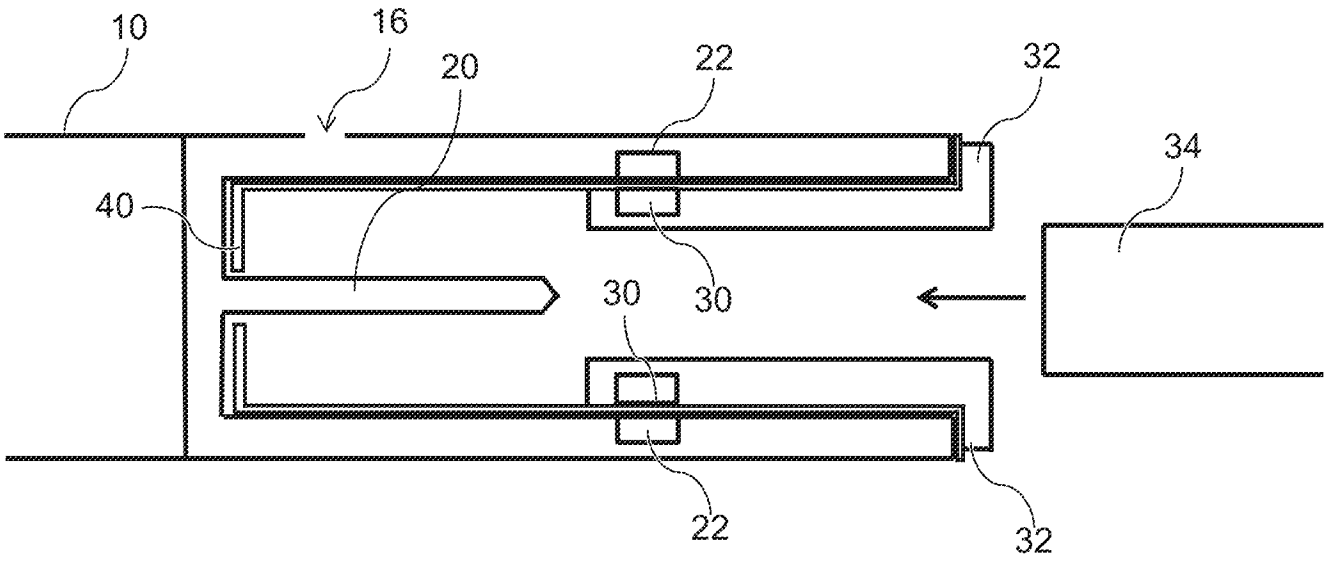

As shown in FIG. 7B, the extractor element 40 may be inserted into the heating chamber 18 and then the adapter element 24 may be inserted into the heating chamber 18 as well. In this case, the adapter element 24 is inserted into the extractor element 40 so that the extractor element 40 is arranged between the adapter element 24 and the heating chamber 18. In the embodiment depicted in FIG. 7B, the extractor element 40 is configured to facilitate removal of a depleted aerosol-generating article 34 due to the base 44 of the extractor element 40 contacting an aerosol-generating article 34 during removal of the extractor element 40. The adapter element 24 is configured to reduce the diameter of the heating chamber 18 to enable usage of aerosol-generating articles 34 of the second type having a reduced diameter.

The aerosol-generating device and the adapter element 24 enable usage of aerosol-generating articles 34 of different diameters. Aerosol-generating articles 34 of the first type (having a relatively larger diameter than aerosol-generating articles of a second type) may be used in the aerosol-generating device without inserted adapter element 24. Aerosol-generating articles 34 of the second type (having a relatively smaller diameter than the aerosol-generating articles of the first type) may be used in the aerosol-generating device with inserted adapter element 24. A user may use aerosol-generating articles 34 of a first type or of a second type in any sequence or order which the user so desires.

For example, the user may utilize the aerosol-generating device without inserting the adapter element 24 into the heating chamber 18. Instead, the user may use aerosol-generating articles 34 of the first type. In this case, the aerosol-generating device does not need to be modified and the heating chamber 18 is already configured for usage of aerosol-generating articles 34 of the first type. The user may thus insert an aerosol-generating article 34 of the first type into the heating chamber 18. After depletion of the aerosol-forming substrate of the aerosol-generating article 34 of the first type due to heating of the substrate by a heating element of the device, the user may remove the aerosol-generating article 34 of the first type. The user is then free to decide which type or aerosol-generating article to use next. If the user wants to again use an aerosol-generating article 34 of the first type, the user does not change the aerosol-generating device. Particularly, the user does not insert the adapter element 24 into the heating chamber 18. Instead, the user inserts a new aerosol-generating article 34 of the first type into the heating chamber 18 and starts operation of the aerosol-generating device.

If the user wants to use aerosol-generating articles 34 of the second type, the user may change the diameter of the heating chamber 18 with ease by inserting the adapter element 24 into the heating chamber 18. Generally, a user may like both normal aerosol-generating articles 34 and slim or super slim diameter aerosol-generating articles 34. With the adapter element 24, it becomes possible to use different types of aerosol-generating articles 34 in a single aerosol-generating device. After insertion of the adapter element 24 into the heating chamber 18, aerosol-generating articles 34 of the second type may be used. Some users may wish to use aerosol-generating articles 34 of the first type after usage of aerosol-generating articles 34 of the second type. In this case, the user removes the adapter element 24 from the heating chamber 18. After removal of the adapter element 24 from the heating chamber 18, aerosol-generating articles 34 of the first type may be used again. The user may thus amend the system back and forth for usage of aerosol-generating articles 34 of first type and aerosol-generating articles of the second types by inserting and removing the adapter element 24 into and from the heating chamber 18.

The invention claimed is:

1. A system, comprising:

an aerosol-generating device comprising a heating chamber, the heating chamber being configured to receive an aerosol-generating article of a first type, wherein the aerosol-generating article comprises an aerosol-forming substrate, and an adapter element configured to be inserted into the heating chamber of the aerosol-generating device, wherein the adapter element is further configured to have an outer shape to be at least partly inserted into the heating chamber, wherein the adapter element has a cavity extending along a longitudinal axis of the adapter element, wherein the cavity is configured so that an aerosol-generating article of a second type having a diameter that is smaller than a diameter of the aerosol-generating article of the first type is insertable into the cavity and thereby into the heating chamber, wherein the adapter element comprises a detection element configured to enable identification, by the aerosol-generating device, of a type of the adapter element inserted into the heating chamber, wherein the heating chamber comprises a detection element configured to detect the type of adapter element inserted into the heating chamber, wherein the detection element of the heating chamber is one or more of a sensor, a poka yoke, encoding, a magnet, a color element, and an electrically conductive element, and wherein the detection element of the adapter element is one or more of a sensor, a poka yoke, encoding, a magnet, a color element, and an electrically conductive element.

2. The system according to claim 1, wherein the adapter element has a cylindrical outer shape.

3. The system according to claim 1, wherein the cavity of the adapter element has a circular cross section.

4. The system according to claim 1, wherein the adapter element is further configured to reduce an opening diameter of the heating chamber for inserting the aerosol-generating article of the second type to an inner diameter of the cavity of the adapter element for inserting the aerosol-generating article of the second type.

5. The system according to claim 1, wherein the adapter element further comprises a stopper configured to prevent over insertion of the adapter element into the heating chamber.

6. The system according to claim 5, wherein the stopper is further configured as one or more of a protruding rim, a groove, an extending element, a ridge, or a handhold.

7. The system according to claim 3, wherein the adapter element further comprises a retaining element, which is configured to attach the adapter element to the heating chamber after insertion of the adapter element into the heating chamber.

8. The system according to claim 1, wherein the system further comprises the aerosol-generating article, wherein the aerosol-generating article comprises the aerosol-forming substrate, and wherein the aerosol-generating article is of the first type.

9. The system according to claim 1, wherein the system further comprises the aerosol-generating article, wherein the aerosol-generating article comprises the aerosol-forming substrate, and wherein the aerosol-generating article is of the second type.

10. The system according to claim 1, wherein the detection element of the heating chamber is further configured to interact with the corresponding detection element of the adapter element for detection of the type of adapter element.

11. The system according to claim 1, wherein the system further comprises an extractor element, wherein the extractor element is configured having an outer shape to be at least partly inserted into the heating chamber between the adapter element and an inner wall of the heating chamber, wherein the extractor element is further configured to be movable between an operation position and an extraction position, wherein the extractor element is further configured for at least partly separating the aerosol-forming article from a heating element of the aerosol-generating device in the extraction position.

12. A method, comprising:

i) providing a system according to claim 1;

ii) at least partly inserting the adapter element into the heating chamber;

iii) inserting the aerosol-generating article of the second type into the cavity of the adapter element;

iv) heating the aerosol-forming substrate of the aerosol-generating article of the second type by means of a heating element of the aerosol-generating device to generate an inhalable aerosol;

during or after step ii) and before step iv), detecting, by means of at least one of the detection element of the adapter element and the detection element of the heating chamber, the type of adapter element inserted into the heating chamber; and after the detecting, during step iv), controlling a heating regime of the heating element on a basis of the detected adapter element in dependence on the detecting.

13. The method according to claim 12, further comprising, before step i):

inserting the aerosol-generating article of the first type into the heating chamber; and heating the aerosol-forming substrate of the aerosol-generating article of the first type by means of the heating element of the aerosol-generating device to generate the inhalable aerosol.

14. The method according to claim 12, further comprising, after step iv):

removing the adapter element from the heating chamber;

inserting the aerosol-generating article of the first type into the heating chamber; and heating the aerosol-forming substrate of the aerosol-generating article of the first type by means of the heating element of the aerosol-generating device to generate the inhalable aerosol.

15. A kit, comprising:

a system comprising an aerosol-generating device comprising a heating chamber, the heating chamber being configured to receive an aerosol-generating article of a first type, wherein the aerosol-generating article comprises an aerosol-forming substrate; and an adapter element configured to be inserted into the heating chamber of the aerosol-generating device, wherein the adapter element is further configured to have an outer shape to be at least partly inserted into the heating chamber, wherein the adapter element has a cavity extending along a longitudinal axis of the adapter element, wherein the cavity is configured so that an aerosol-generating article of a second type having a diameter that is smaller than a diameter of the aerosol-generating article of the first type is insertable into the cavity and thereby into the heating chamber, and wherein the adapter element comprises a detection element configured to enable identification, by the aerosol-generating device, of a type of the adapter element inserted into the heating chamber, wherein the detection element of the adapter element is one or more of a sensor, a poka yoke, encoding, a magnet, a color element, and an electrically conductive element; and a set of adapter elements, wherein each adapter element of the set of adapter elements is configured having an outer shape to be at least partly inserted into a heating chamber of an aerosol-generating device, wherein said each adapter element has a cavity extending along a longitudinal axis of the adapter element, wherein the cavity is configured so that an aerosol-generating article comprising an aerosol-forming substrate is insertable into the cavity, and wherein the adapter elements of the set are different from each other in one or more of a diameter of the cavity, a color, a surface structure, or a shape for enabling different aerosol-generating articles to be used in the aerosol-generating device.

* * * * *